US005178081A

United States Patent [19]

von-Hagen et al.

[11] Patent Number: 5,178,081

[45] Date of Patent: Jan. 12, 1993

[54] METERING DEVICE FOR SEWING MACHINES

[75] Inventors: Wolf-Rudiger von-Hagen, Hemmingen; Horst Pordzik, Gerlingen, both of Fed. Rep. of Germany

[73] Assignee: Union Special G.m.b.H., Stuttgart, Fed. Rep. of Germany

[21] Appl. No.: 520,585

[22] Filed: May 8, 1990

[30] Foreign Application Priority Data

May 26, 1989 [DE] Fed. Rep. of Germany ..... 3917130

[51] Int. Cl.[5] ..... D05B 35/06

[52] U.S. Cl. ..... 112/121.26; 112/152; 112/305

[58] Field of Search ..... 112/121.26, 121.27, 112/152, 121.11, 121.15, 2, 303, 305; 242/55

[56] References Cited

U.S. PATENT DOCUMENTS 3,074,632 1/1963 Braun et al. ..... 112/121.11 X
4,389,951 6/1983 von Hagen ..... 112/121.27
4,475,474 10/1984 von Hagen et al. ..... 112/121.26
4,590,874 5/1986 Baclagis ..... 112/121.27 X

FOREIGN PATENT DOCUMENTS 0978035 11/1975 Canada ..... 112/121.26
63-52913 10/1988 Japan ..... 112/121.26
2110190 6/1983 United Kingdom ..... 112/121.26

*Primary Examiner*—Peter Nerbun
*Attorney, Agent, or Firm*—Morgan & Finnegan

[57] ABSTRACT

A tape feed device for an elastic tape from a supply at a sewing machine having a biased actuating lever, whose angular position varies in dependence upon the size of a loop and which controls the motor of a take-off roller. An adjuster, which is electrically actuable in a controlled manner, acts on the actuating lever in such a way that the tape tension can be altered in accordance with an electrical variable. The adjuster has a coil whose electromagnetic field lines cut an armature which is connected to the actuating lever.

5 Claims, 3 Drawing Sheets

Union Special

Union Special

Union Special

METERING DEVICE FOR SEWING MACHINES

BACKGROUND OF THE INVENTION

The present invention relates to tape feed devices for a sewing machine.

Tape feed devices have been utilized for feeding an elastic tape for sewing machines. A tape feed device is disclosed in GB-A-2,110,190 and DE 31 42 195 C2. This tape feed device has an actuating lever which engages a loop in the tape and which is biased by a spring. In order to increase the tension in the elastic tape, the force of the spring, and hence the force exerted by the actuating lever on the loop of the tape, can be increased using an adjusting device. As a result, although it is possible to alter the tension in the tape, an expensive mechanical adjusting mechanism is required, which allows controlled alteration of the tension in the tape to an approximate degree only.

SUMMARY OF THE INVENTION

The present invention relates to an improved tape feed device for feeding elastic tape for a sewing machine.

The tape feed device of the present invention comprises, an adjusting device having at least one motor-driven take-off roller for the tape, a biased actuating lever having a roller thereon which engages a loop of the tape, a switch with which the actuating lever cooperates in accordance with its angular position dependent upon the size of the loop, and an adjuster for the adjusting device.

A feature of the invention is that the adjuster is electrically actuable in a controlled manner and acts on the actuating lever in such a way that the tension in the tape can be altered in accordance with an electrical variable.

Another feature of the invention is that a controlled increase in tension in the tape is provided in a simplified manner over a wide range with a high degree of accuracy.

Yet another feature of the invention is that the tension in the tape can be adjusted very finely over a wide range.

A further feature of the invention is that the device may have a coil to provide an efficient adjuster of reduced cost.

Still another feature of the invention is that the device may have a coder switch to vary the tape tension in a stepwise manner.

Yet another feature of the invention is that the device may have a plurality of coder switches to permit calling-up of different tensions in the tape.

Thus, a feature of the invention is that the device permits predetermined variable tensions to be processed.

Another feature of the invention is that the device may have a comparator to evaluate steps by which tension in the tape can be progressively increased.

A further feature of the invention is that the device permits virtually instantaneous adjustment of the tension in the tape in a simplified manner.

Further features will become more fully apparent in the following description of the embodiments of this invention and from the appended claims.

DESCRIPTION OF THE PREFERRED EMBODIMENTS

Figure 1:
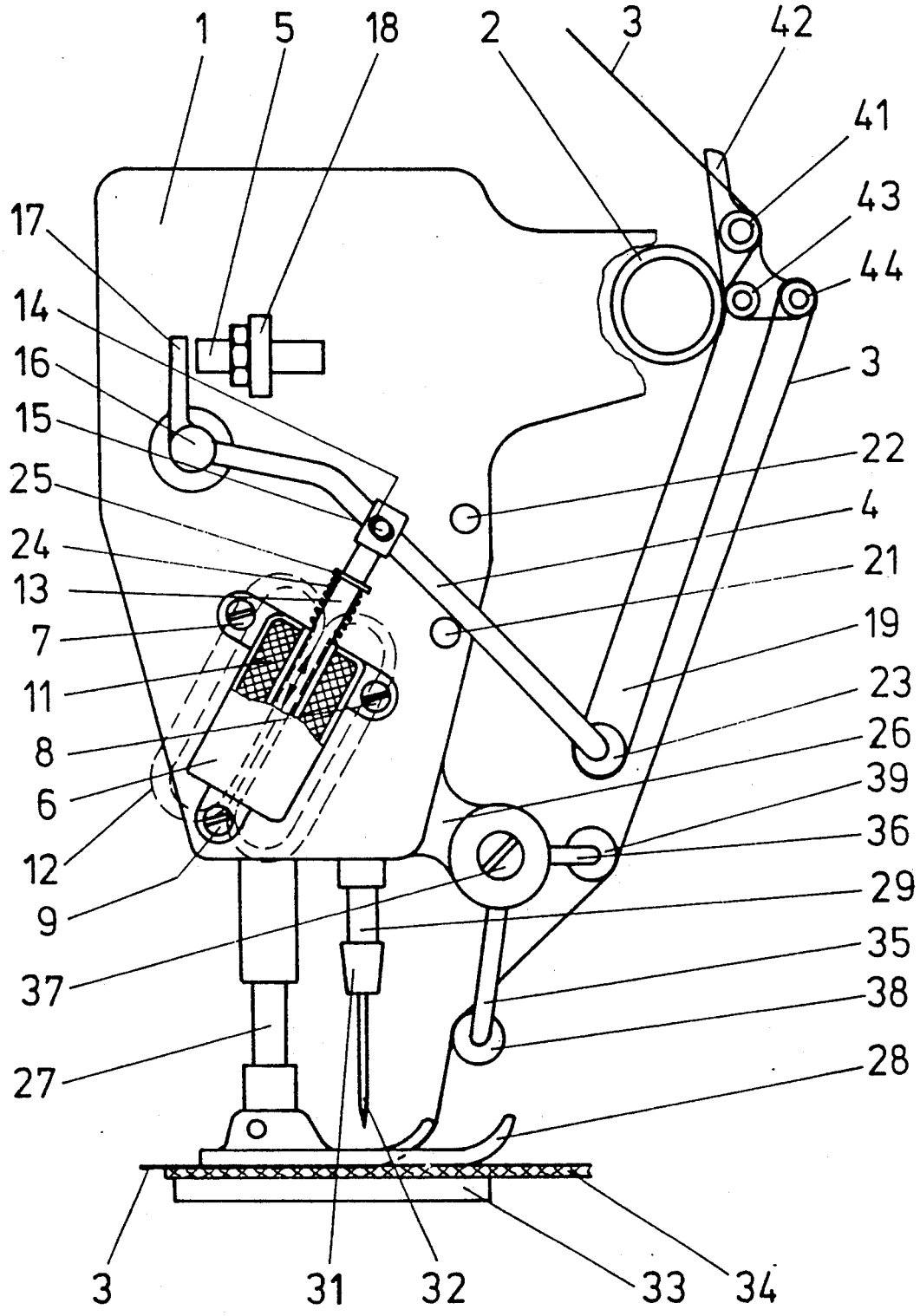
FIG. 1 is a fragmentary side elevational view of a tape feed device for a sewing machine of the present invention.
Figure 2:
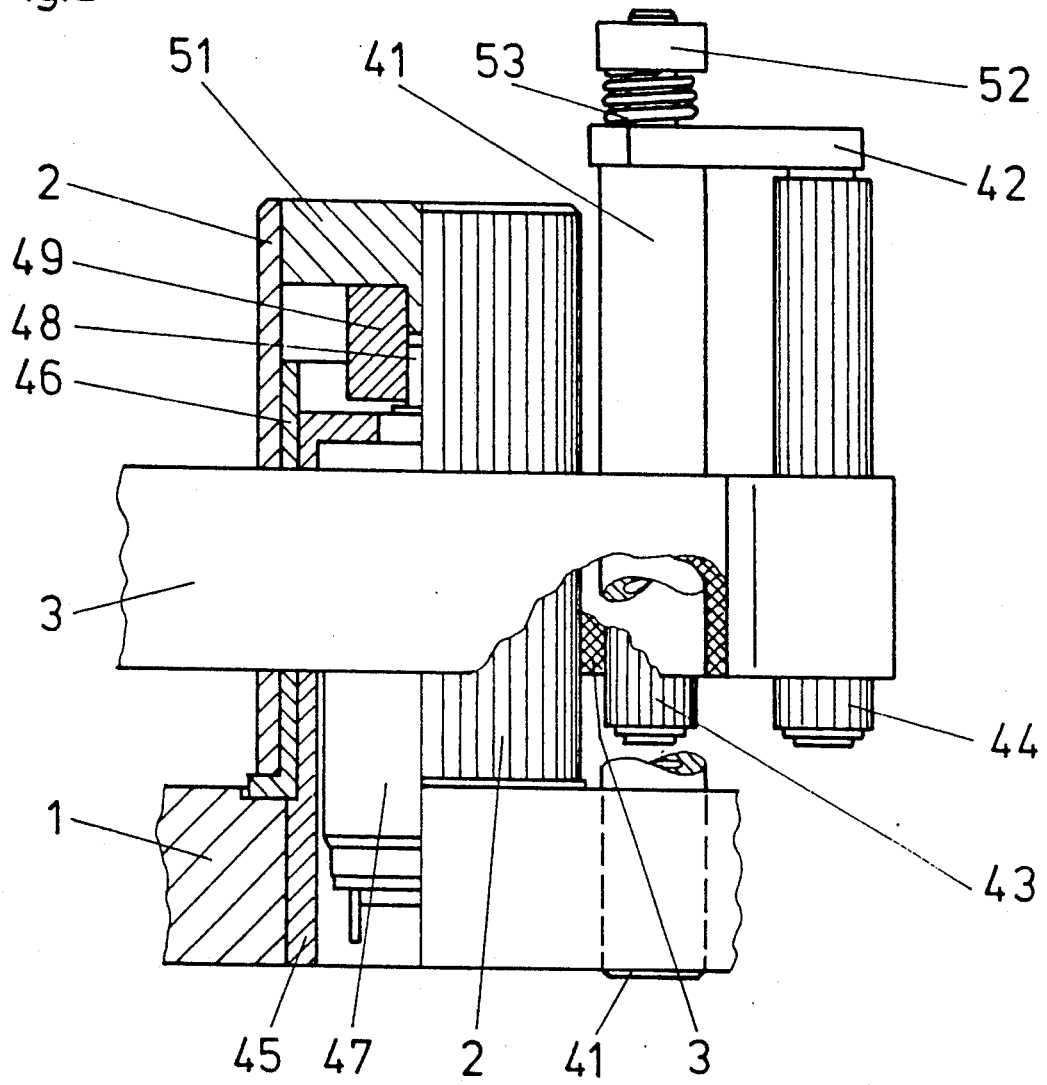
FIG. 2 is a fragmentary plan view, partly broken away, of a part of the tape feed device of FIG. 1.

Referring now to FIGS. 1 and 2, there is shown a head cover 1 which is disposed on a sewing machine and carries a tape feed device. This device comprises a motor-driven take-off roller 2 for an elastic tape 3 taken from a supply, an actuating lever 4, a switch 5, which is in the form of a contactless switch, for switching the drive of the take-off roller 2 on and off, and an adjuster 6, which is fastened by three screws 7, 8 and 9 to the head cover 1.

The adjuster 6 has a coil 11 which carries current in a controlled manner and whose electromagnetic field lines 12 cut an armature 13. The armature, which can be moved backwards and forwards in the direction of the arrows, has an opening 14, into which a pin 15 of the actuating lever 4 projects, which lever is mounted by a journal 16 in the head cover 1. As shown in the drawings, the adjuster 6, which is electrically actuated in a controlled manner, is in the form of a linear magnet but it could be a rotary magnet, whose rotary armature acts on the journal 16. The adjuster 6 could be any kind of motor having controllable torque or controllable step position, wherein the torque or the step positions determine the prevailing tension in the tape 3. The important point is that the adjuster can be influenced electrically in such a way that the mechanical tension in the tape is accordingly electrically or electronically alterable in a controlled manner.

The actuating lever 4 carries a roller 23 around which a loop 19 is formed. A switching tab 17 on the actuating lever 4 actuates the switch 5, which is fastened on a holder, when the loop 19 of the tape 3 diminishes in size, and in doing so activates the drive of the take-off roller 2. Alteration of the angular position of the actuating lever 4 is mechanically limited by two stop pins 21 and 22.

The dead weight of the actuating lever 4 and the armature 13 is compensated approximately by a spring 24 which rests on the coil 11 of the adjuster 6 and on a collar 25 on the armature 13.

A resiliently guided presser rod 27, on which a presser foot 28 is secured, projects out of the housing 26. A needle bar 29, which also projects out of the housing 26 and moves in a reciprocating manner, carries a needle head 31 having a needle 32. The tape 3 and a workpiece 34 are guided in a resiliently clamped manner between the presser foot 28 and a needle plate 33.

Two angled pins 35 and 36, each of which in turn carries a guide roller 38 and 39 respectively, are fastened to the housing 26 by a screw 37.

As shown in FIGS. 1 and 2, a holder 42 is pivotally mounted on a hollow bolt 41, which is fastened to the head cover 1 (part of which is shown broken away), the holder in turn carrying a nip roller 43 and a further guide roller 44. The nip roller 43 urges the tape 3 against the take-off roller 2 and ensures that the tape 3 is moved forwards or backwards. A shell 45 is also secured to the head cover 1. The hollow take-off roller 2 is pivotally disposed on the shell 45 by means of a bearing 46. The shell 45 houses a motor 47, whose shaft 48 is connected by way of a coupling piece 49 and a journal cover 51 to the take-off roller 2 for the tape 3. The holder 42 is urged in the direction to bias the nip roller 44 towards the take-off roller 2 by a spring 53, which is disposed on the hollow bolt 41 and secured by a ring 52, so that the nip roller 43 is in permanent abutment against the tape 3, which in turn has frictional contact with the take-off roller.

Figure 3:
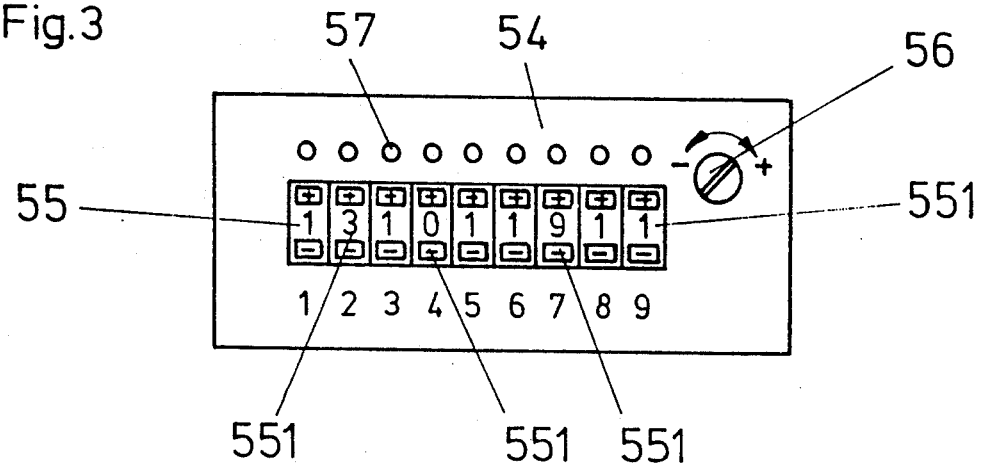
FIG. 3 is a front view of a preselector switch for the device of FIG. 1.
Figure 4:
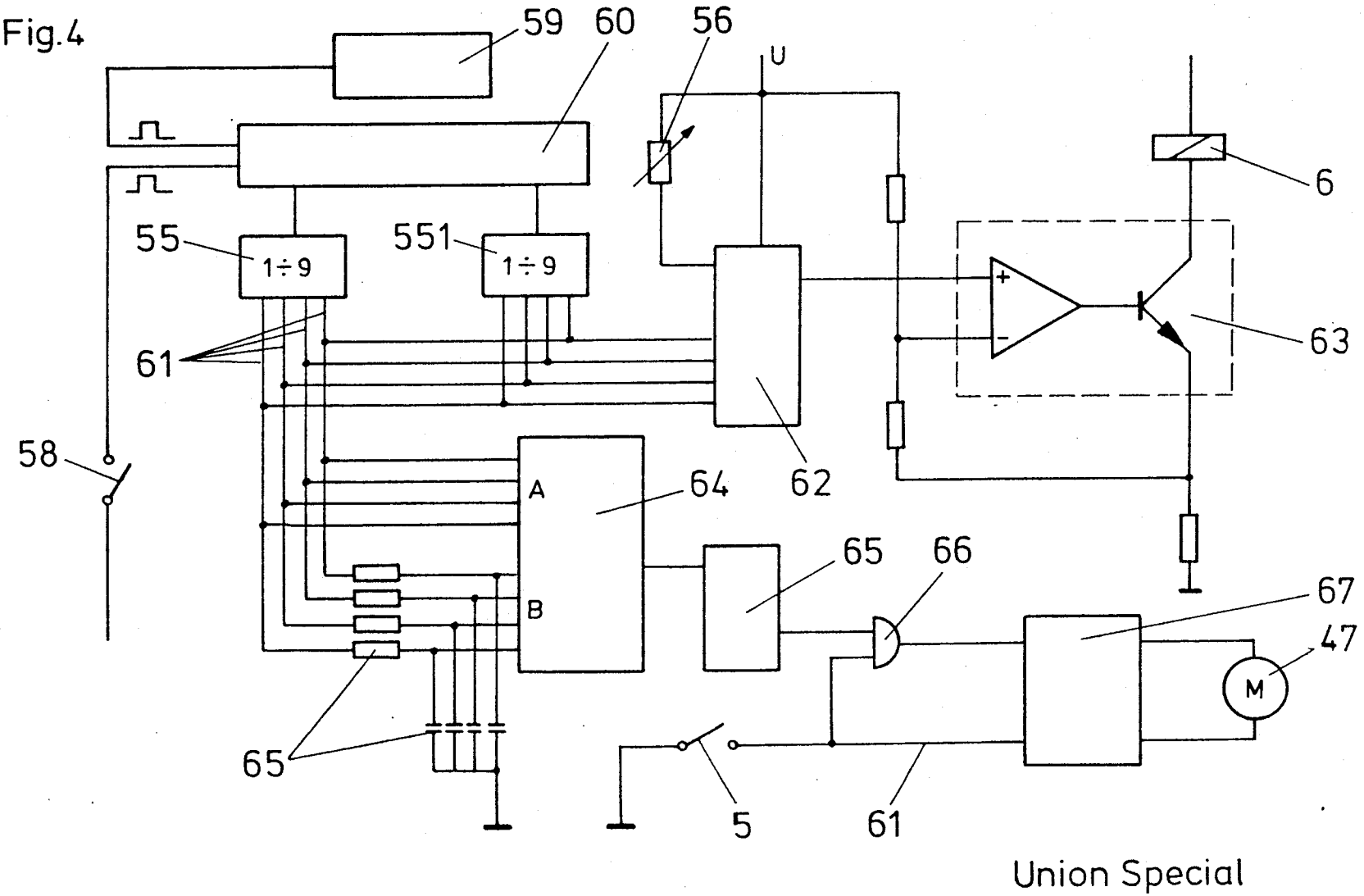
FIG. 4 is a circuit diagram for the tape feed device of FIG. 1.

The preselector switch 54 shown in FIG. 3 has nine coder switches 55, 551 at which and using which various stages for various tensions in the tape can be set. In each of the nine coder switches 55, 551, any tension in a range from 1 to 9 can be set in the tape 3. 1 corresponds to minimum tape tension and 9 to maximum tape tension. A potentiometer 56 may be used for separate stepless adjustment of the tension in the tape 3. If a plurality of different tape tensions is required in one seam on a workpiece 34, a first tape tension can be set at the first coder switch 55, a second tape tension can be set at the second coder switch 551, a third tape tension can be set at the third coder switch 551, etc. The end of the callable program is set using the figure 0, for example on the fourth coder switch 551. Light indicators 57 above the coder switches 55, 551 show the stage of the program at any one moment. As shown in FIG. 4, the steps can be called up manually, for example by a pulse (Ω), by way of an electrical knee-operated switch 58 or may be pulsed from a programmable control device 59, which interrogates the coder switches 55, 551 (only two of which are shown in FIG. 4) in sequence by way of a counter circuit 60.

At each of the coder switches 55, 551 a binary number 1 to 9 can be set, which is converted by way of lines 61 in a D/A converter 62 into a corresponding voltage U. As a result of this variable voltage U, a variable current I flows through an amplifier stage 63, actuates the adjuster 6 and in doing so generates the electromagnetic field lines 12 of varying strength, which causes tensions of varying strengths in the tape 3.

The potentiometer 56, which is connected separately on the input side of the D/A converter 62, also permits direct influence of the field lines 12 of the adjuster 6.

The change to a higher tape tension, that is to a higher binary number, is detected by a comparator 64 (4-bit comparator). This information is immediately present at an input A, but is delayed at an input B by the provision of R-C members 65. If a new signal A is larger than the signal previously preset at B, a timer 65 is pulsed, which allows the motor 47 to run backwards for a predetermined period, for example one second. The backward running of the motor 47 is, however, terminated earlier if the preselected tension in the tape 3 is reached first, that is the switch 5 is closed and this information is transmitted via an AND gate 66 to a motor circuit 67.

If the tension in the tape 3 increases during the sewing operation, the switch 5 is actuated and the motor 47 is driven forwards by way of the motor circuit 67 until the loop 19 is large enough for the switch 5 to switch off again.

If it is desired to draw together portions of the sewn workpiece 34, the force generated in the adjuster 6 is increased or the torque acting on the actuating lever 4 is increased so that the tension in the tape 3 is adjusted to a higher value. The duration of the increased tension exerted on the tape 3 can be determined manually by way of a knee switch 58 or a timer or counter of the programmable control device 59; the value of the tension may be predetermined in stages by means of the coder switches 55, 551 or steplessly adjusted by means of the potentiometer 56.

The foregoing detailed description has been given for clearness of understanding only, and no unnecessary limitations should be understood therefrom, as modifications will be obvious to those skilled in the art.

What is claimed is:

1. A tape feed device for feeding an elastic tape from a supply at a sewing machine for the controlled change in the tension of the tape, comprising:

an adjusting device having at least one motor-driven take-off roller for the tape, a biased actuating lever having thereon a roller which engages a loop of the tape, a switch with which the actuating lever co-operates in accordance with the angular position of said actuating lever, which is dependent upon the size of the loop, and an adjuster for the adjusting device, said adjustor being electrically actuable in a controlled manner and acting on the actuating lever in such a way that the tension in the tape can be altered in accordance with an electrical variable, in which the tension in the tape is varied in stages which are adjustable by a coder switch, and in which said stages for increasing tension in the tape are evaluatable by a comparator, whereby the movement of the motor-driven take-off roller can be reversed.

2. A tape feed device for feeding an elastic tape from a supply at a sewing machine for the controlled change in the tension of the tape, comprising:

an adjusting device having at least one motor-driven take-off roller for the tape, a biased actuating lever having thereon a roller which engages a loop of the tape, a switch with which the actuating lever co-operates in accordance with the angular position of said actuating lever, which is dependent upon the size of the loop, and an adjuster for the adjusting device, said adjustor being electrically actuable in a controlled manner and acting on the actuating lever in such a way that the tension in the tape can be altered in accordance with an electrical variable, in which the tension in the tape is steplessly adjustable by means of a potentiometer.

3. A tape feed device for feeding an elastic tape in a sewing machine, comprising:

an adjusting means having a take-off roller for the tape;

means for driving said take-off roller;

an actuating lever having means for engaging a loop of the tape;

means for driving said actuating lever;

switch means responsive to said actuating lever;

an adjuster having an armature for driving said actuating lever, thereby modifying the position of the actuating lever;

electric means for actuating said adjuster responsive to an electrical variable, and a coder switch for adjusting the tension of the tape in stages.

4. The tape feed device of claim 3 further comprising:

a comparator for evaluating stages for increasing tape tension such that movement of the take-off roller can be reversed.

5. A tape feed device for feeding an elastic tape in a sewing machine, comprising:

an adjusting means having a take-off roller for the tape;

means for driving said take-off roller;

an actuating lever having means for engaging a loop of the tape;

means for driving said actuating lever;

switch means responsive to said actuating lever;

an adjuster having an armature for driving said actuating lever, thereby modifying the position of the actuating lever;

electric means for actuating said adjuster responsive to an electrical variable, and a potentiometer for adjusting the tension of the tape.

* * * * *